US010005973B2

(12) United States Patent
Li et al.

(10) Patent No.: US 10,005,973 B2
(45) Date of Patent: Jun. 26, 2018

(54) PULVERIZED COAL GASIFICATION FURNACE WITH MULTI-LEVEL FEEDING OF HIGH SPEED CIRCULATING GASIFICATION AGENT AND GASIFICATION METHOD

(71) Applicant: Harbin Institute of Technology, Harbin, Heilongjiang Province (CN)

(72) Inventors: Zhengqi Li, Harbin (CN); Zhichao Chen, Harbin (CN); Lingyan Zeng, Harbin (CN); Haopeng Wang, Harbin (CN); Xiaoying Liu, Harbin (CN); Bingkun Jiang, Harbin (CN); Qunyi Zhu, Harbin (CN); Yukun Qin, Harbin (CN)

( * ) Notice: Subject to any disclaimer, the term of this patent is extended or adjusted under 35 U.S.C. 154(b) by 191 days.

(21) Appl. No.: 14/906,757

(22) PCT Filed: Sep. 30, 2015

(86) PCT No.: PCT/CN2015/091286

§ 371 (c)(1),
(2) Date: Jan. 21, 2016

(87) PCT Pub. No.: WO2017/041338

PCT Pub. Date: Mar. 16, 2017

(65) Prior Publication Data

US 2017/0240825 A1 Aug. 24, 2017

(30) Foreign Application Priority Data

Sep. 11, 2015 (CN) ..... 2015 1 0578724
Sep. 11, 2015 (CN) ..... 2015 1 0578725
Sep. 11, 2015 (CN) ..... 2015 1 0578780

(51) Int. Cl.
*C10J 3/50* (2006.01)
*C10J 3/48* (2006.01)
(Continued)

(52) U.S. Cl.
CPC ..... *C10J 3/466* (2013.01); *C10J 3/485* (2013.01); *C10J 3/506* (2013.01); *C10J 3/721* (2013.01);
(Continued)

(58) Field of Classification Search
CPC ..... C10J 2300/093; C10J 2300/0956; C10J 2300/1631; C10J 3/466; C10J 3/485; C10J 3/506; C10J 3/721
See application file for complete search history.

(56) References Cited

U.S. PATENT DOCUMENTS

2013/0084224 A1* 4/2013 Ergut ..... B01J 4/002 422/224

FOREIGN PATENT DOCUMENTS

CN 202786142 U * 3/2013
CN 104745233 A * 7/2015

* cited by examiner

*Primary Examiner* — Amber R Orlando
*Assistant Examiner* — Syed T Iqbal
(74) *Attorney, Agent, or Firm* — Novoclaims Patent Services LLC; Mei Lin Wong

(57) ABSTRACT

A pulverized coal gasification furnace with multi-level feeding of high speed circulating gasification agent which includes a pulverized coal gasification furnace and a gasification method. The present invention solves the existing problems in short life of burner, uneven slag deposition on the surface of the gasification device which causes burning and corrosion, and uneven temperature distribution along the height direction. The steps are: 1. setting parameters for the gasification chamber; 2. feeding pulverized coal; 3. burning pulverized coal to form molten slag; 4. gasification process of molten slag inside the gasification furnace; 5. removing slag. In the present invention, the furnace body is divided into different levels for the gasification agent, the internal temperature of the furnace along the height direction
(Continued)

is evenly distributed, and the furnace is applicable to the coal types which has severe change in ash viscosity in response to temperature changes.

14 Claims, 11 Drawing Sheets

(51) Int. Cl.
*C10J 3/46* (2006.01)
*C10J 3/72* (2006.01)

(52) U.S. Cl.
CPC .. *C10J 2300/093* (2013.01); *C10J 2300/0956* (2013.01); *C10J 2300/1631* (2013.01)

PULVERIZED COAL GASIFICATION FURNACE WITH MULTI-LEVEL FEEDING OF HIGH SPEED CIRCULATING GASIFICATION AGENT AND GASIFICATION METHOD

CROSS REFERENCE TO RELATED APPLICATION

This is a national phase national application of an international patent application number PCT/CN2015/091286 with a filing date of Sep. 30, 2015, which claimed priority of three foreign applications in China as follow: application number 2015105787802 and filing date Sep. 11, 2015; application number 2015105787253 and filing date Sep. 11, 2015; application number 2015105787249 and filing date Sep. 11, 2015. The contents of these specifications, including any intervening amendments thereto, are incorporated herein by reference.

BACKGROUND OF THE PRESENT INVENTION

Field of Invention

The present invention relates to a gasification furnace and gasification method, and more particularly to a pulverized coal gasification furnace with multi-level feeding of high speed circulating gasification agent and gasification method, which belongs to the field of coal gasification.

Description of Related Arts

Coal gasification technologies are highly efficient and clean coal technologies. The current gasification technologies are categorized into four groups: moving bed gasification, fluidized bed gasification, entrained bed gasification and molten bath gasification. Since entrained bed gasification has the advantages of high gasification level, great production power and high rate of coal conversion, this is the current major development direction in coal gasification technologies. The entrained bed gasification has two major characteristics. First, the operation temperature is high, approximately 1300° C.~1600° C., the ash formed inside the gasification chamber is in fluid state. The other characteristic is "slag for slag resistance" technology which is used to protect the furnace body and to reduce heat loss. The drawback of existing entrained bed gasifier (see FIG. 18) are as follows: (1) the burner has a short life. The average lifetime of a burner is around 1 year. (2) The inner surface of the gasification furnace is easily damaged. This problem will lead to the frequent stop of operation of gasifier. As gasifiers are the production source for chemical industry, the stop in operation will cause a complete shutdown of the entire production line, and the shutdown of the entire production line will result in a huge economic loss to the company. For example, the economic loss of a one-time shutdown of a gasification production line with a gas production capacity of 80000 $Nm^3/h$ is more than 40 million yuan. (3) There is uneven temperature distribution along the height direction and problem of local overheating.

SUMMARY OF THE PRESENT INVENTION

An objective of the present invention is to solve the problems of short life of burner, and uneven slag deposition onto the inner surface of the gasification device which causes burning and corrosion of inner surface of the gasification device by providing a pulverized coal gasification device with multi-level feeding of high speed circulating gasification agent and gasification method.

Accordingly, in order to solve the above problems, the present invention employs the following technological solution:

According to the device of the present invention, the device comprises a pulverized coal burner, a gasification furnace body, a water-cool wall, a syngas channel, the water-cool wall is arranged on an inner wall of the gasification furnace body, the water-cool wall is formed by a plurality of vertical tubes, a circular cavity, namely the gasification chamber, is encircled by the water-cool wall; the pulverized coal burner is positioned on a top portion of the gasification furnace body and the axis of the pulverized coal burner is overlapped with the axis of the gasification chamber; a slag pool is arranged in a bottom portion of the gasification furnace body, the syngas channel is arranged at an outer side wall in a lower portion of the gasification furnace body in a manner that the syngas channel and the gasification chamber is channeled through; the pulverized coal gasification furnace with multi-level feeding of high speed circulating gasification agent further comprises gasification agent injection ports, flow control valves, swirl vane units, a pulverized coal channel and gasification agent channels, the injection ports are arranged at a side wall in an upper portion of the gasification furnace body, the injection ports are inserted inside the gasification chamber along a tangential direction of the gasification chamber; each gasification agent injection port 7 comprises a flow control valve, the ring-shaped gasification agent channel and the ring-shaped pulverized coal channel are coaxially and radially extended from the inner side to the outer side of the pulverized coal burner; the pulverized coal channel and the gasification agent comprise a swirl vane unit 9 near the combustion side respectively. The number of gasification agent injection ports 7 is 1, 2, 3 or 4. The plurality of gasification agent injection ports are evenly distributed and sequentially arranged from the top to the bottom along the height direction in the upper portion of the gasification furnace body. The center of all the gasification agent injection ports are positioned on the same vertical line perpendicular to the horizontal plane.

The method of the present invention are realized through the steps as follows:

Step 1: setting parameters for the gasification chamber;

Setting the internal pressure of the gasification chamber to 0.1~4 MPa, the operating temperature to 1250~1600° C.;

Step 2: feeding pulverized coal;

Feeding the pulverized coal with a temperature of 25~100° C., carried by the nitrogen gas or carbon dioxide gas in a circulating gas flow pattern, through a pulverized coal channel on a pulverized coal burner, to the gasification chamber of the gasification furnace; injecting the gasification agent, which is 10%~40% of total volume and has a temperature of 20~400° C. and has a circulating gas flow pattern, through a gasification agent channel on a pulverized coal burner to the gasification chamber of the gasification furnace; the gasification agent and the pulverized coal are mixed in a top section of the gasification furnace and flow at the same direction downwardly in a circular pattern;

Step 3: burning pulverized coal to form molten slag

The mixture gas flow of the pulverized coal and gasification agent contact the entrained high temperature syngas in the center backflow region and are ignited by the high temperature syngas to form a molten slag in the top portion of the gasification chamber through burning;

Step 4: Gasification process of molten slag inside the gasification furnace

The remaining gasification agent, which is 60%~90% of total volume and has a temperature of 20~400° C., through the gasification agent injection port on the side wall, is injected into the gasification chamber at a tangential direction and at a speed of 100~200 m/s, the high speed gasification agent is flowed into the gasification chamber and form a very strong circular gas flow, then under the centrifugal effect, 70%-80% of the molten slag is forced to the inner wall to form a relatively thick slag layer, that the slag layer is a uniform slag layer, and the circular gas flow is acting onto the slag layer on the inner wall of the gasification chamber continuously through which a very vigorous gasification reaction is occurred;

Step 5: Slag removal;

The crude coal syngas produced by gasification process flows out the gasification chamber through the syngas channel, the liquid slag produced flows to the slag pool along the wall surface and is discharged from the gasification furnace through a slag outlet in the bottom portion.

In the step 4, the gasification agent is injected through the injection port into the gasification chamber tangentially at a multi-stage manner or at a multi-level manner along the height of the furnace. In the step 2 and the step 4, the gasification agent are both oxygen and steam; the mass ratio of steam and oxygen is 0~0.4:1. In the step 2, the volume of pulverized coal is 1%~25% of the total volume of the mixture gas of pulverized coal and nitrogen. In the step 2, the volume of pulverized coal is 1%~25% of the total volume of the mixture gas of pulverized coal and carbon dioxide.

Compared to existing gasification furnaces and method of gasification, the present invention has the following advantageous effects:

1. According to the present invention, the molten slag layer is formed by centrifugation. In the existing art (see FIG. 18), the pulverized coal and the gasification agent are both injected from the top portion of the gasification furnace, the pulverized coal enters into the gasification chamber and then forms molten slag under high temperature, the molten slag and the gasification agent are flow in the same direction, usually flow in a vertical downwardly pattern towards the bottom portion of the furnace.

During the flowing process, only a very small amount of molten slag near the wall side will form a slag film onto the wall through airflow pulsation. On the contrary, according to the present invention, the pulverized coal and about 10%-~40% of the gasification agent is injected from the top portion of the furnace, and are mixed to burnt inside the gasification chamber to form the molten slag, while the remaining gasification agent is injected tangentially at a speed of 100~200 m/s in a multi-level manner along the height direction into the gasification chamber, thus a very strong circulating airflow is formed inside the gasification chamber. Under the effect of the circulating airflow, the molten slag and the gasification agent are both forced to flow in a circulating manner downwardly near the inner wall of the gasification chamber, about 80% of the molten slag is under the continuously effect of strong centrifugal force at a direction towards the wall surface area to form a molten slag layer onto the wall.

2. According to the present invention, the molten slag layer formed onto the wall of the gasification chamber has a large amount of molten slag and a large thickness of slag layer. In the existing art, the pulverized coal and the gasification agent are both injected from the top portion of the gasification furnace, the pulverized coal enters into the gasification chamber and then forms molten slag under high temperature, the molten slag and the gasification agent are flow in the same direction, usually flow in a vertical downwardly pattern towards the bottom portion of the furnace. During the flowing process, only a very small amount of molten slag near the wall side will form a slag film onto the wall through airflow pulsation, the molten slag which is at a position farther away from the wall cannot adhere onto the wall, thus only about 10% of the molten slag can adhere onto the wall to form the slag film layer. Since the slag amount is small, the layer thickness is relatively thin, which is about 2 mm~3 mm in general; the present invention relies on centrifugal force to force the molten slag to form the slag layer onto the wall surface: about 60%~90% gasification agent is injected into the gasification chamber at a speed of 100 m/s~200 m/s to form the strong circular airflow and generates a centrifugal force which is sufficiently strong to force the molten slag to form the slag layer onto the wall surface, during the gasification process, about 80% of the molten slag is forced towards the wall and form the slag layer onto the wall, since the slag amount which is adhered onto the wall is large, the slag layer on the wall is relatively thick, that the thickness of the slag layer can reach 5 mm~6 mm.

3. According to the present invention, the slag layer on the wall has a relatively uniform thickness. In the existing art, the pulverized coal and the gasification agent are both injected from the top portion of the gasification furnace, the pulverized coal enters into the gasification chamber and then forms molten slag under high temperature, the molten slag and the gasification agent are flow in the same direction, usually flow in a vertical downwardly pattern towards the bottom portion of the furnace. During the flowing process, only a very small amount of molten slag near the wall side will form a slag film onto the wall through airflow pulsation, the molten slag which is at a position farther away from the wall cannot adhere onto the wall, thus only about 10% of the molten slag can adhere onto the wall to form the slag film layer. Since the amount of the slag which is adhered on the wall is small, when the airflow distribution along the circumferential direction of the gasification furnace is uneven, the adhering of the molten slag onto the wall along the circumferential direction is uneven, thus causing an uneven thickness of the slag film layer along the circumferential direction. In the present invention, the pulverized coal and about 10%~40% of the gasification agent is injected from the top portion of the furnace, and are mixed to burnt inside the gasification chamber to form the molten slag, while the remaining gasification agent is injected tangentially at a speed of 100~200 m/s in a multi-level manner along the height direction into the gasification chamber, thus a very strong circulating airflow is formed inside the gasification chamber. Under the effect of the circulating airflow, the molten slag and the gasification agent are both forced to flow at a high speed in a circulating manner downwardly near the inner wall of the gasification chamber. According to the present invention, the airflow speed is high while the turbulence intensity is great, thus facilitating the mixing process of the gasification agent and molten slag. After the molten slag and the gasification agent along the circumferential direction are mixed uniformly, the slag layer is formed on the wall under the effect of the strong centrifugal force which is generated from the strong circulating movement, therefore the slag layer on the wall has a relatively uniform and even thickness.

4. The present invention can protect the wall surface of the furnace more effectively. The major composition of the slag layer on the wall surface is silicon dioxide. Silicon dioxide has a thermal conductivity of about 7.6 W/m·K, while a common firebrick has a thermal conductivity of 20 W/m·K~28 W/m·K, the thermal conductivity of silicon dioxide is small than that of the firebrick, therefore the slag layer has a superior insulating effect. In the existing technologies, the slag film thickness is 2 mm~3 mm in general while the slag layer thickness is uneven along the circumferential direction, thus it is prone to the problem of incomplete coverage of slag film layer on parts of the wall surface. The wall surface of the gasification furnace is exposed into high temperature gas environment and is easily burnt by overheating. Inside the gasification furnace, the gas content includes 60%~70% carbon monoxide, and carbon monoxide at high temperature is corrosive gas. The gasification furnace is exposed under high temperature and under a carbon monoxide rich environment, thus chemical corrosion is easily occurred. In the present invention, the slag layer thickness has reached 5 mm~6 mm, which is 2~3 times greater compared to existing technologies, while the slag layer thickness is relatively uniform and prevent the exposure of the inner wall of the gasification furnace under the high temperature gas environment, thus is capable of protecting the wall surface of the gasification furnace against the high temperature gas from burning more effectively; also, the relatively thick slag layer can separate the inner wall surface of the gasification furnace and the gas inside the furnace (which includes 60%~70% carbon monoxide), thus further providing protection to the inner wall surface of the gasification furnace against the chemical corrosion of carbon monoxide.

5. In the present invention, the oxygen consumption requirement is low. In the existing technologies, the slag film layer on the wall is thin and uneven, and the slag film thickness is 2 mm~3 mm in general. In the present invention, the slag layer is thick and uniform and the slag layer thickness can reach 5 mm~6 mm, which is 2~3 times greater than the existing technologies. The thermal conductivity of the slag layer is small, the insulating effect is great, and therefore the present invention can reduce the heat loss on the wall surface. The energy release by the reaction of carbon and oxygen to produce carbon monoxide is 112.1 kJ/mol and the energy release by the reaction of carbon and oxygen to produce carbon dioxide is 395 kJ/mol. Obviously, the energy release by the reaction of carbon and oxygen to produce carbon dioxide is greater than the energy release by the reaction of carbon and oxygen to produce carbon monoxide by 3.52 times. The process of gasification of pulverized coal requires high temperature condition (which is 1250° C.~1600° C.) for rapid reaction. Though the desire product from coal gasification process is carbon monoxide, in order to maintain a relatively high temperature inside the furnace, an excess amount of oxygen is required to introduce to produce carbon dioxide to increase the temperature. In the existing technologies, the heat loss in the wall is relatively large. In the actual operation, in order to adjust the current ratio of oxygen atom and carbon atom to 1.05~1.1, an excess amount of 5%~10% oxygen is introduced to generate carbon dioxide to maintain the temperature of the furnace. In the present invention, the slag layer is thick and the heat loss of the wall is small, adjusting the current ratio of oxygen atom and carbon atom to 1.01~1.05 can already maintain the same level of high temperature inside the furnace. Compared to the existing technologies, the oxygen consumption is lowered by approximately 5%. Oxygen is obtained by separation process from the air and the separation process consumes a great amount of energy. The present invention can dramatically decrease the oxygen consumption and save a lot of energy.

6. The present invention has a great level of coal types applicability. In order to achieve the technology of "slag for slag resistance" in the fluidized bed gasification furnace for the protection of wall surface, a relatively thick layer of slag layer has to be ensured on the water-cool wall surface. In the existing technologies, the formation of slag film layer merely relies on the molten slag near the wall to adhere onto the wall surface and the slag amount which is adhered onto the wall is extremely small. Under the condition that extremely small slag amount is adhered onto the wall, in order to reach a certain thickness of slag layer, the requirement of viscosity-temperature properties of the coal powder is very strict: within the temperature range of gasification, the viscosity of the coal powder cannot be too high or too low. If the viscosity of the coal powder is too low, then the fluidity of the molten slag is good, the slag film is relatively thin and fails to provide protection effect on the water-cool wall. If the viscosity of the coal powder is too high, the fluidity of the molten slag is lowered, the molten slag flows slowly near the slag outlet and the slag removal process is not smooth. The stringent requirement of viscosity-temperature properties of the coal powder means that the applicability of the existing furnace for different coal types are relatively poor and a suitable coal type must be selected for normal operation. In the present invention, 80% of the molten slag are forced towards the wall surface and the slag layer with a certain thickness is formed in the water-cool wall. The thickness of the slag layer is not sensitive to the viscosity-temperature properties of the coal powder, therefore the present invention has extremely great applicability for different coal types. In the time of fluctuation of coal price in the market, the gasification furnace which has "non-selective property" towards the coal can provide multiple options to the manufacturer and dramatically increase the profitability of the corporation.

7. Under the condition of identical volume and pressure, the present invention can provide the pulverized coal with a long retention time, a long gasification time and a high rate of gasification. (1) Under the condition of identical size and pressure of gasification chamber, compared to the existing gasification furnace, the pulverized coal of the present invention has long retention time and gasification time. The trajectory track of the pulverized coal and gasification agent is shown in FIG. 18 of the drawings: the gasification agent carries the pulverized coal to flow from the top portion of the furnace vertically downward to the bottom. Since the grain size of a pulverized coal is usually smaller than 75 mm, the airflow has an extremely strong carrying capacity to the pulverized coal. The retention time of the pulverized coal is the time from the gasification agent carrying the pulverized coal from the top portion of the furnace to the time flowing vertical downward towards the bottom portion. The retention time is very short, which is about 4 s~6 s. According to the present invention, the molten slag is under the effect of the centrifugal force, approximately 80% of the molten slag is forced to the wall to form the slag layer, and the retention time inside the furnace is the liquid slag from the top portion of the furnace which flows slowly along the wall towards the bottom portion. Since about 60%~90% of the gasification agent is tangentially injected inside the gasification chamber and has a circular airflow pattern inside the gasification chamber, the gasification agent has very weak carrying capacity to the downward flow of molten slag on the wall surface. In addition, the viscosity of the liquid state molten slag is relatively greater, thus greatly extend the retention time of the pulverized coal inside the gasification furnace. The retention time is 12 s~16 s, which is 2~4 times greater than the retention time of the existing technology under the same chamber size and pressure condition. (2) The present invention provides high reaction rate. The temperature inside the gasification furnace is relatively high, the gasification reaction belongs to a diffusion-controlled area. The diffusion-controlled area refers to a phenomenon that under relatively high temperature, the reaction rate is extremely high, causing any gas which reaches the surface of the coal particle will react with the carbon element immediately and depleted quickly. Then, diffusion through the boundary layer becomes the controlling factor, while the diffusion through the boundary layer is controlled by the relative speed between the pulverized coal and the gasification agent. Therefore, the relative speed between the pulverized coal and the gasification agent inside the gasification chamber become the determining factor for the rate of gasification reaction. In existing technologies, after the pulverized coal and the gasification agent is emitted from the burner about 10% of the total amount of molten slag will adhere to the wall to form the slag film, and the remaining molten slag will flow together at the same direction with the gasification agent. About 90% of the total amount of molten slag will flow at the same direction at a relatively lower speed, the flow speed is about 0.4 m/s~0.6 m/s. The relative speed between them is even lower, which is about 0.08 m/s~0.12 m/s. The gasification reaction occurs between molten slag on the slag film on the wall and the flow of gasification agent near the wall, and their relative speed is approximate to the flow rate of the flow of the gasification agent, which is about 0.4 m/s~0.6 m/s. The relative speed is relatively low, the diffusion of gas particles to the coal particle surface is very slow and the rate of gasification reaction is low. In the present invention, under the effect of the strong centrifugal airflow, about 80% of the total amount of molten slag forms the slag layer on the wall, and the remaining molten slag circulates with the gasification agent inside the furnace, The slag layer flows downwardly along the wall surface while the gasification agent is circulating at a high speed to exerting force onto the slag layer. The speed of the gasification agent along the tangential direction in the injection port is 100 m/s~200 m/s and is gradually decreased in the flowing process. The speed of the gasification agent along the tangential direction in the syngas outlet is reduced to 50 m/s~100 m/s, and the average speed of the gasification agent along the tangential direction is 75 m/s~150 m/s. The relative speed of the molten slag on the wall and the gasification agent is approximate to the speed of the gasification agent along the tangential direction, and the average speed is 75 m/s~150 m/s, which is 900~1200 times of the existing technologies. About 20% of the total amount of molten slag is circulating inside the furnace with the gasification agent, and the average speed of the gasification agent is 75 m/s~150 m/s. The speed of the gasification agent is high, the turbulence intensity is great, and the rate of gasification reaction is high. This shows that the gasification agent in the present invention has a high speed, the relative speed between the pulverized coal and the gasification agent is great, and the speed of gas diffusion to the particle surface is great, therefore the gasification efficiency of the present invention is far greater than that of the gasification furnace with existing technologies.

8. In the present invention, the ignition is relied on the backflow of the high temperature backflow and the ignition is stable. In the existing technologies, the pulverized coal is injected into the gasification chamber and then is flowing together with the gasification agent downwardly. During the downward flowing process, the pulverized coal is subjected to radiation by the high temperature syngas and its temperature is increased gradually. When its temperature is increased to the level which is higher than its ignition point, the pulverized coal is ignited. Because of the interference in the field of airflow inside the gasification chamber and the fluctuation of the temperature field, the position of ignition location of the pulverized coal and the timing of ignition will be affected to fluctuate, hence the ignition is unstable. According to the present invention, since the circulating airflow is flowing near the wall of the gasification chamber, the pressure in the center of the gasification chamber is relatively lower, the high temperature gas in the bottom portion of the gasification chamber is sucked into the center of the gasification chamber and form a stable central high temperature backflow zone. The high temperature airflow in the center high temperature backflow region will backflow to the root of the burner and mixing with the airflow of the pulverized coal and gasification agent to ignite the pulverized coal such that a stable ignition process for the pulverized coal is ensured.

9. The airflow of pulverized coal is stable. Under normal operation, the pulverized coal injected through the burner is in the form of solid particle. The temperature is increased gradually as the pulverized coal is flowing downward, and the pulverized coal in solid state is gradually melted to liquid state. When the pulverized coal is carried by the airflow to flow downward to reach gasification agent injection port, the pulverized coal in solid state is melted completely to slag in liquid state. The slag is then carried by the strong airflow of gasification agent injected from the injection port of the furnace body, and forced onto the wall inside the furnace under the effect of centrifugal force, thus flowing downwardly along the wall surface while having gasification reaction with the gasification agent. In the invention that the gasification agent is injected from the top portion at high speed, since the gasification agent is injected at a tangential direction of the furnace, a strong circular field of airflow is formed inside the gasification furnace, and a high speed circulating airflow against the wall surface of the gasification furnace. The circulating airflow is diffused upward to the top portion of the gasification chamber, and forms a circulating airflow close to the wall surface in the cone region of the top portion. Inside the gasification chamber since the circulating airflow is flowing near the wall surface region, the pressure in the center of the gasification chamber is relatively lower, the high temperature syngas in the bottom portion of the gasification chamber is sucked into the center of the gasification chamber and moves upward to form a high temperature center backflow region, that the high temperature backflow is flowing upward to the top portion of the gasification chamber. This shows that three airflow is present in the top portion of the gasification chamber, which are the strong circulating airflow which is close to the wall surface, the high temperature backflow in the center, and the pulverized coal airflow injected into the gasification chamber through the burner between the two other airflow. After the pulverized coal airflow is injected into the gasification chamber at a relatively low speed of 1~8 m/s, the pulverized coal airflow is located between the strong circulating airflow which is close to the wall surface and the high temperature backflow in the center and is pressed by the two airflows. When changes in the loading of the gasification furnace or the temperature of the gasification agent being injected occur, changes in the strength of the circulating airflow near the wall inside the gasification furnace will occur, which will lead to changes in the gasification agent circulating airflow region near the wall in the top portion of the gasification furnace and the center backflow region, and ultimately lead to the changes in pressure of the strong circulating airflow near the wall and the center backflow onto the pulverized coal airflow. Since the pulverized coal airflow injected into the gasification chamber has a low speed, low momentum and poor rigidity, when the pressure of the center backflow on the pulverized coal airflow is greater than the pressure of the circulating airflow near the wall to the pulverized coal airflow, the pulverized coal will backflow towards the wall surface; when the pressure of the circulating airflow near the wall on the pulverized coal airflow is greater than the pressure of the center backflow on the pulverized coal airflow, the pulverized coal airflow is shifted towards the center of the gasification chamber. This shows that the pulverized coal airflow is easily shifted and moving back and forth along the diameter direction in the top portion of the gasification furnace. When the pulverized coal airflow vibrates back and forth along the diameter direction in the top portion of the gasification furnace, the following problems will occur: (1) when the pressure of the center backflow on the pulverized coal airflow is greater than the pressure of the circulating airflow near the wall to the pulverized coal airflow, the pulverized coal will backflow towards the wall surface. This may cause the solid state pulverized coal particles and the liquid state molten slag to become very close to the wall surface in the top portion of the furnace before the pulverized coal reaches the gasification agent injection port, and are carried by the circulating airflow near the wall surface and is forced to the wall surface in the top portion of the furnace by the effect of centrifugal force. The solid state pulverized coal particles will collide and force towards the wall surface of the top portion of the furnace continuously and the wall surface in the top portion of the furnace will be damaged seriously, thus easily led to the occurrence of water-cool pipe fracture and stop operation of the gasification furnace; (2) when the pressure of the circulating airflow near the wall on the pulverized coal airflow is greater than the pressure of the center backflow on the pulverized coal airflow, the pulverized coal airflow is shifted towards the center of the gasification chamber. Since the pulverized coal airflow has a downward movement, the center backflow will shift away from the burner. The pulverized coal fails to contact the high temperature backflow gas in time, the ignition of pulverized coal is delayed, thus easily led to the occurrence of extinguishment. According to the present invention, about 10%~40% of total gasification agent is injected from the burner in the top portion at a high speed of 100 m/s 200 m/s, the flow momentum of the gasification agent is great, which is about 8~60 times of the total flow volume of the pulverized coal, the two airflow is mixed gradually after being injected in the same direction to form an overall flow of gas mixture with great rigidity, so the effect of the circulating airflow near the wall and the center backflow on the pulverized coal airflow is small, the trajectory of the pulverized coal airflow is stable and the stability of ignition is ensured. The inventors have conducted a 1:5 cold-state model test with a gasification furnace having a gas production capacity of 40000 $Nm^3/h$, the testing parameters are: airflow velocity of pulverized coal at 3 m/s, airflow velocity of gasification agent injected by burner in the top portion at 150 m/s, airflow velocity of gasification agent injected to the gasification chamber at 200 m/s. The cold state model test discovers that: when no gasification agent is injected from the top portion of the gasification furnace, the flow volume of the pulverized coal airflow is 0.27 kg·m/s, the pulverized coal airflow has poor rigidity, the pulverized coal airflow, after injecting into the gasification chamber, is vibrating back and forth along the diameter direction in the upper region of the gasification chamber between the burner and the gasification agent injection port, the pulverized coal flows towards the center of the burner and flows towards the wall alternately, the occurrence of this alternate flow movement reaches 18 times in one minute. After injecting the gasification agent from the top portion of the gasification chamber, the flow momentum of the gasification agent injected from the top portion is 7.47 kg·m/s, the total flow momentum of the pulverized coal airflow and the gasification agent injected from the top portion is 7.74 kg·m/s, which is 28.6 times of the flow momentum of the original pulverized coal airflow, the pulverized coal airflow has strong rigidity, the pulverized coal airflow is stable, and the phenomenon that he pulverized coal flows towards the center of the burner and flows towards the wall alternately and the back and forth vibrating movement along the diameter direction is not observed.

10. According to the present invention, the flow volume of the gasification agent injected from the top burner is great and the speed is high. The present invention is applicable to the type of coal with high volatile content and easily ignition properties. According to the present invention, 10%~40% of the gasification agent is injected at high speed from the top portion through the burner, while the remaining 60%~90% of the gasification agent is injected through the gasification agent channel from the side of the gasification furnace at a tangential direction. The amount of gasification agent injected from the top portion of the gasification chamber is great, its speed reaches the level of 100 m/s~200 m/s, and its carrying capacity is high, while the mixing temperature is relatively low and the ignition is delayed. The ignition region has a relatively greater distance from the burner and effectively protect the burner from burning. Also, according to the present invention, the amount of gasification agent from the top portion is large and ensures quick supply of oxygen after ignition of the pulverized coal, thus maintaining its burning stability. Accordingly, the present invention is applicable to the coal type with high volatile content and easily ignition property.

11. In the present invention, the upper cone region has a relatively higher temperature, so coal types with high ash melting point can be used. According to the present invention, 10%~40% of gasification agent is injected from the top portion through the burner, the remaining 60%~90% of gasification agent is injected through the gasification agent channel from the side of the gasification furnace at a tangential direction. The amount of gasification agent injected from the top portion of the gasification chamber is great, the burning reaction is vigorous, and the temperature is relatively higher. The temperature in the top portion of the gasification chamber is high and it can ensure that coal type with high ash melting point can also form the molten slag in liquid state quickly, that the molten slag is forced to the wall to form a uniform and thick slag layer on the wall under the effect of centrifugal force, the molten slag is flowing downward slowly along the wall surface and the inner wall damage of the gasification chamber is prevented. This shows that the present invention is also applicable to high ash melting point coal types.

12. In the present invention, the furnace body is divided into different level for supplying gasification agent in multi-stage. The internal temperature of the furnace along the height direction is evenly distributed and the present invention is applicable to the coal type which has severe change in ash viscosity in response to temperature changes. In the present invention, 3 level of gasification agent injection ports are arranged along the height direction on the side of the gasification chamber. 60~90% of the gasification agent is injected into the gasification chamber along the tangential direction through the three injection ports, each injection port is arranged for injecting a suitable amount of gasification agent, and the temperature is maintained within normal temperature range after the reaction. Since the gasification agent is distributed relatively evenly along the height direction of the furnace, the internal temperature of the furnace is distributed evenly, the temperature of the upper portion is relatively close to the temperature of the lower portion. In the application with coal type which has severe change in ash viscosity in response to temperature changes, which is difficult to handle for other furnaces with existing technologies, the present invention will not lead to burning accident of the inner wall surface in the upper portion of the gasification chamber from exposure to high temperature gas environment which is caused by high temperature in the upper portion of the gasification. The high temperature can reduce viscosity of the molten slag film, increase flow speed, and thin or disappear the slag layer during the downward flowing process. Also, the present invention will not lead to poor slag removal which is caused by low temperature in the lower portion of the furnace. The low temperature can increase viscosity of the molten slag film and decrease flow speed. Accordingly, the internal temperature of the furnace along the height direction is distributed evenly according to the present invention and is capable of providing application to the coal type which has severe change in ash viscosity in response to temperature changes.

13. The present invention provides a method of supplying gasification agent which is uniformly distributed along the height direction on the upper portion of the furnace and is staggered and leveled along the circumferential direction, thus preventing overheating of the water-cool pipes near the vertical line of the injection port of the gasification agent. Since the gasification chamber utilizes water-cool wall which is constructed by vertical circular pipe, when anthracite coal with relatively high calorific value is used, the vertical circular pipes from the upper portion to the bottom portion around the injection port of the gasification agent is under a high temperature zone continuously, therefore overheating of the pipes of the water-cool wall will occur easily. In the present invention, 2~4 levels of injection ports along the height direction of the furnace is evenly distributed and are aligned in a stagger pattern along the circumferential direction, that the injection ports are not aligned on the same vertical line and the amount of gasification agent near the vertical line of each injection port is relatively small and the oxygen content in the gas flow is relatively lower. When using anthracite coal with relatively high calorific value, the temperature near the vertical line of each injection port is relatively uniform and overheating problem is prevented. Therefore, the present invention is also applicable to anthracite coal with relatively high calorific value.

14. The present invention can reduce the amount of investment. From the above advantageous point 7, the present invention provides the pulverized coal with a much longer retention time and a much higher rate of gasification reaction when compared to existing technologies. The gasification intensity is great. Under the same pressure and same production volume condition, the size of the gasification furnace of the present invention is much smaller than that of the gasification furnace with existing technologies. In addition, the gasification capability is comparable to or even superior to the existing technologies. Accordingly, a large amount of equipment investment is saved.

DETAILED DESCRIPTION OF THE PREFERRED EMBODIMENT

Embodiment 1

Figure 1:
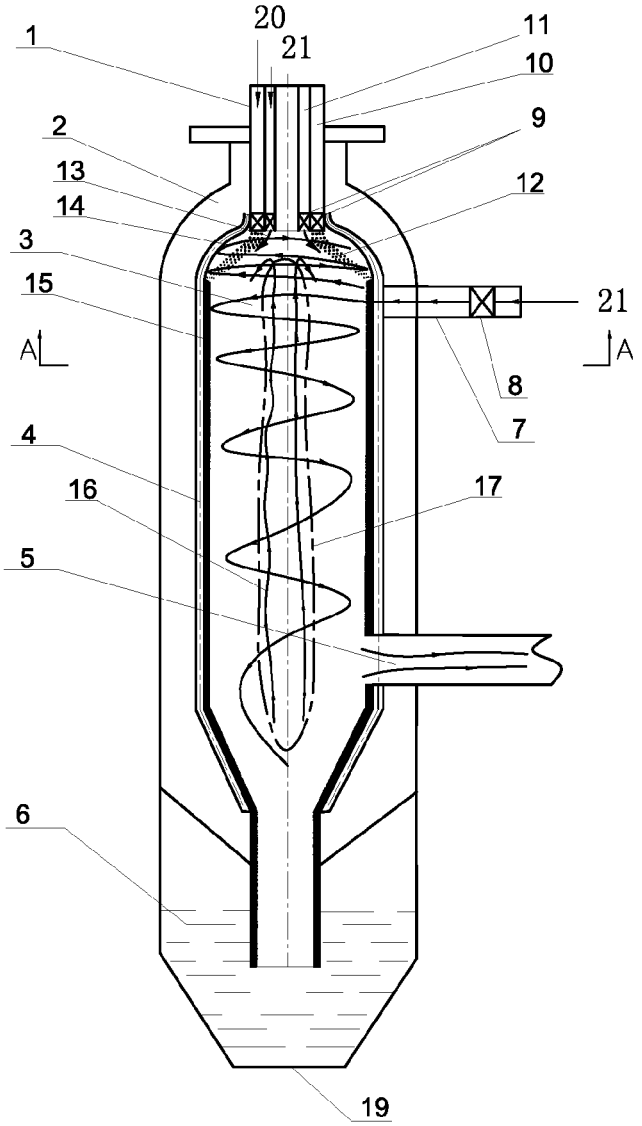
FIG. 1 is an illustration of the overall structure of the gasification furnace with one gasification agent injection port according to the preferred embodiment of the present invention. (the curve lines with arrows refer to the airflow trajectory inside the gasification chamber 3, the numerical reference 12 refers to the flow of pulverized coal, the numerical reference 13 refers to the flow of gasification agent, the numerical reference 14 refers to circulating airflow near the wall in the top portion of the furnace, the numerical reference 15 refers to slag layer, the numerical reference 16 refers to backflow syngas, the numerical reference 17 refers to the boundary of the center backflow region, the numerical reference 19 refers to slag outlet, the numerical reference 20 refers to the injected pulverized coal and nitrogen or pulverized coal and carbon dioxide, the numerical reference 21 refers to the injected gasification agent)
Figure 2:
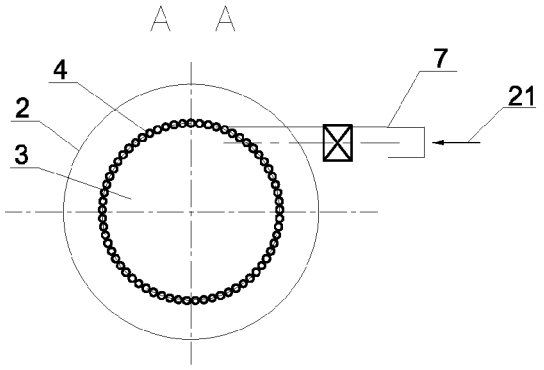
FIG. 2 is an A-A sectional view of FIG. 1.
Figure 3:
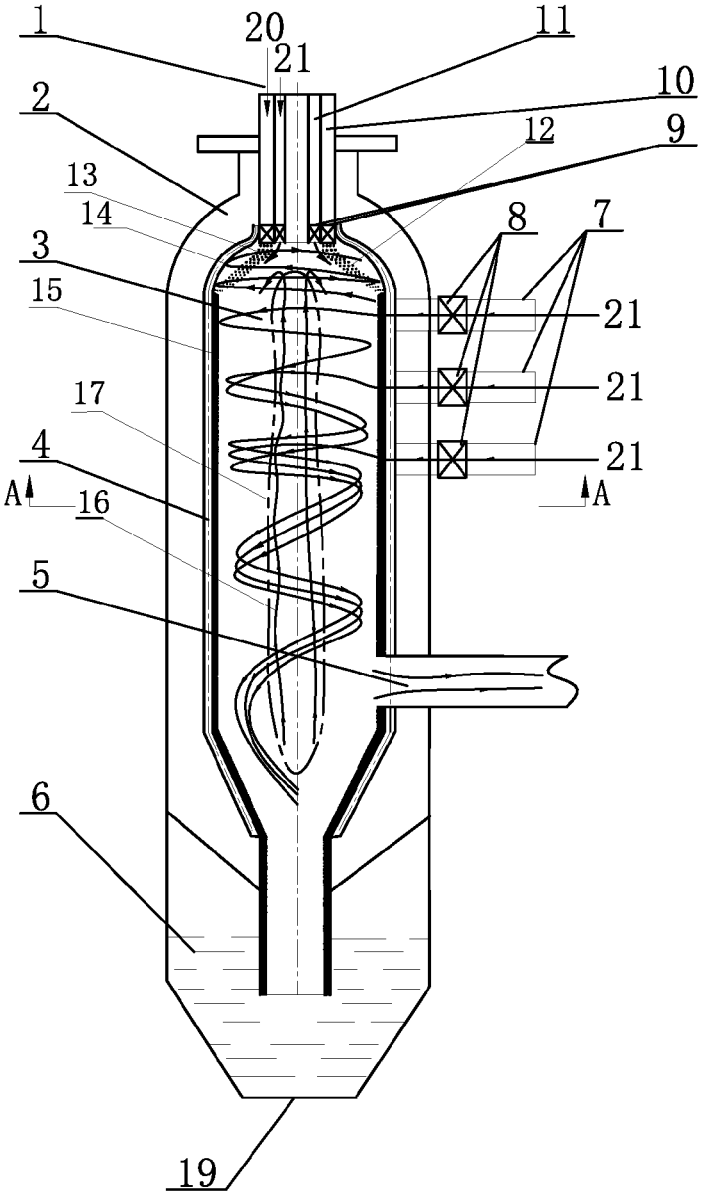
FIG. 3 is an illustration of the overall structure of the gasification furnace when the number of gasification agent injection port is 3 and the center of all the injection ports are aligned on the same vertical line perpendicular to the horizontal plane according to the preferred embodiment of the present invention.
Figure 4:
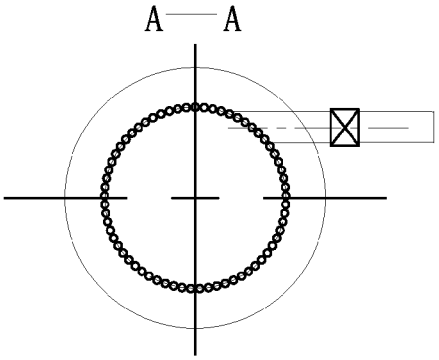
FIG. 4 is an A-A sectional view of FIG. 3.
Figure 5:
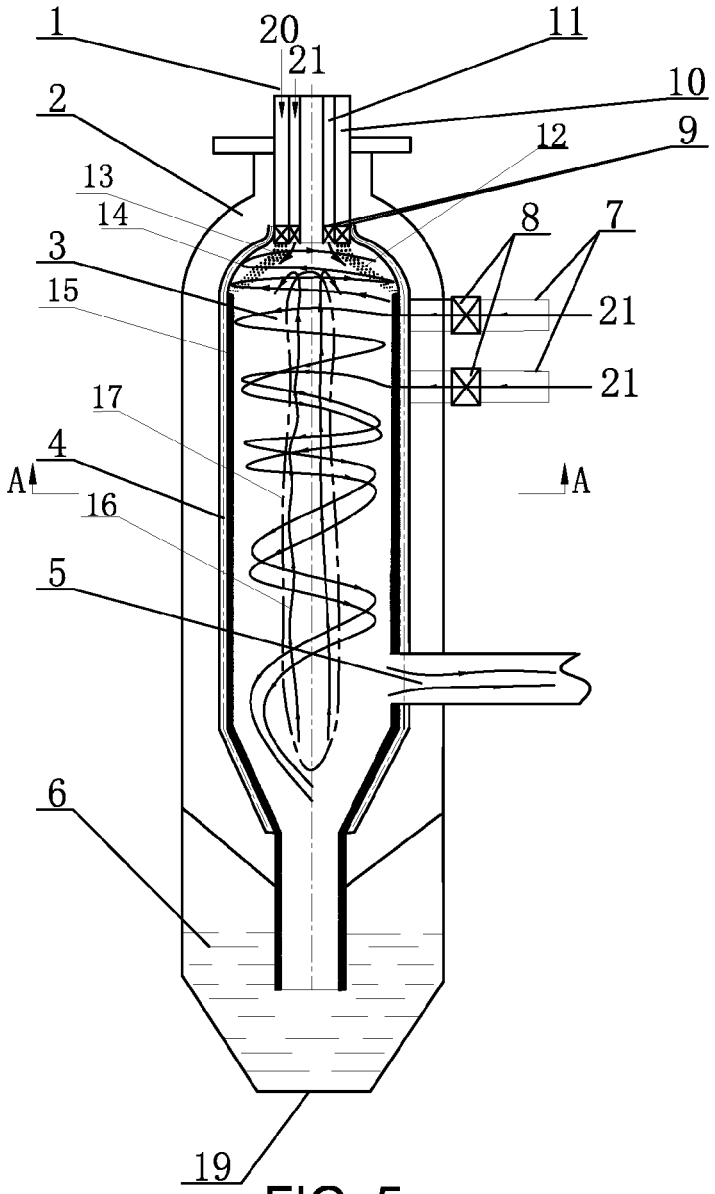
FIG. 5 is an illustration of the overall structure of the gasification furnace when the number of gasification agent injection port is 2 and the center of all the injection ports are aligned on the same vertical line perpendicular to the horizontal plane according to the preferred embodiment of the present invention.
Figure 6:
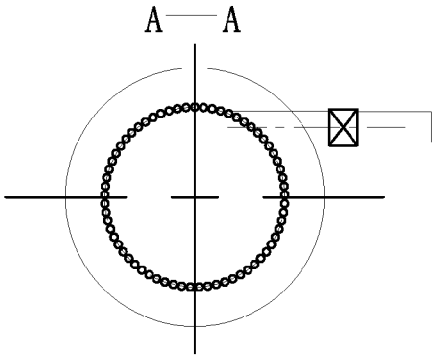
FIG. 6 is an A-A sectional view of FIG. 5.
Figure 7:
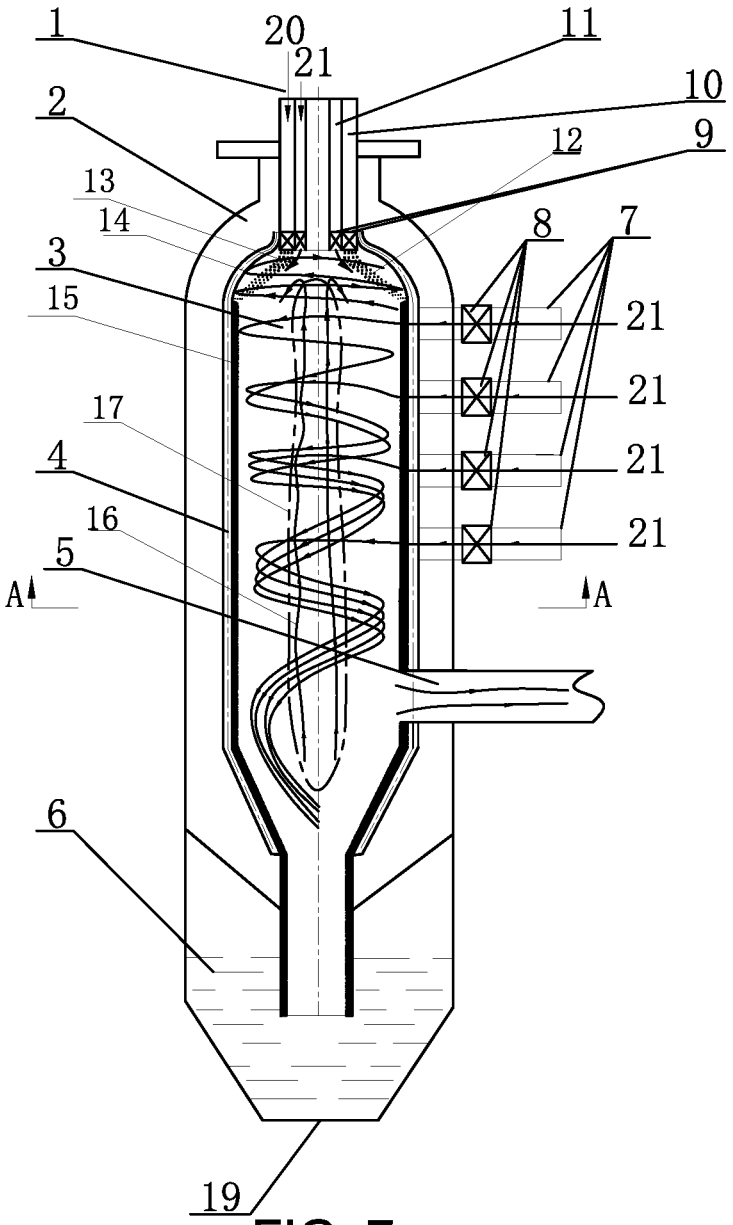
FIG. 7 is an illustration of the overall structure of the gasification furnace when the number of gasification agent injection port is 4 and the center of all the injection ports are aligned on the same vertical line perpendicular to the horizontal plane according to the preferred embodiment of the present invention.
Figure 8:
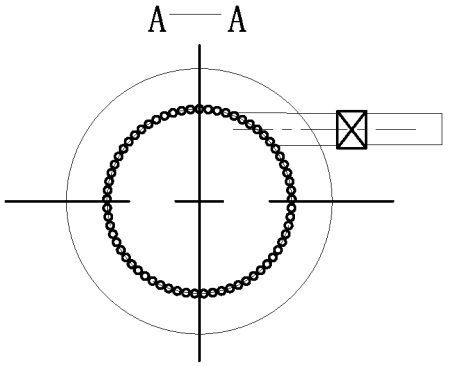
FIG. 8 is an A-A sectional view of FIG. 7.
Figure 9:
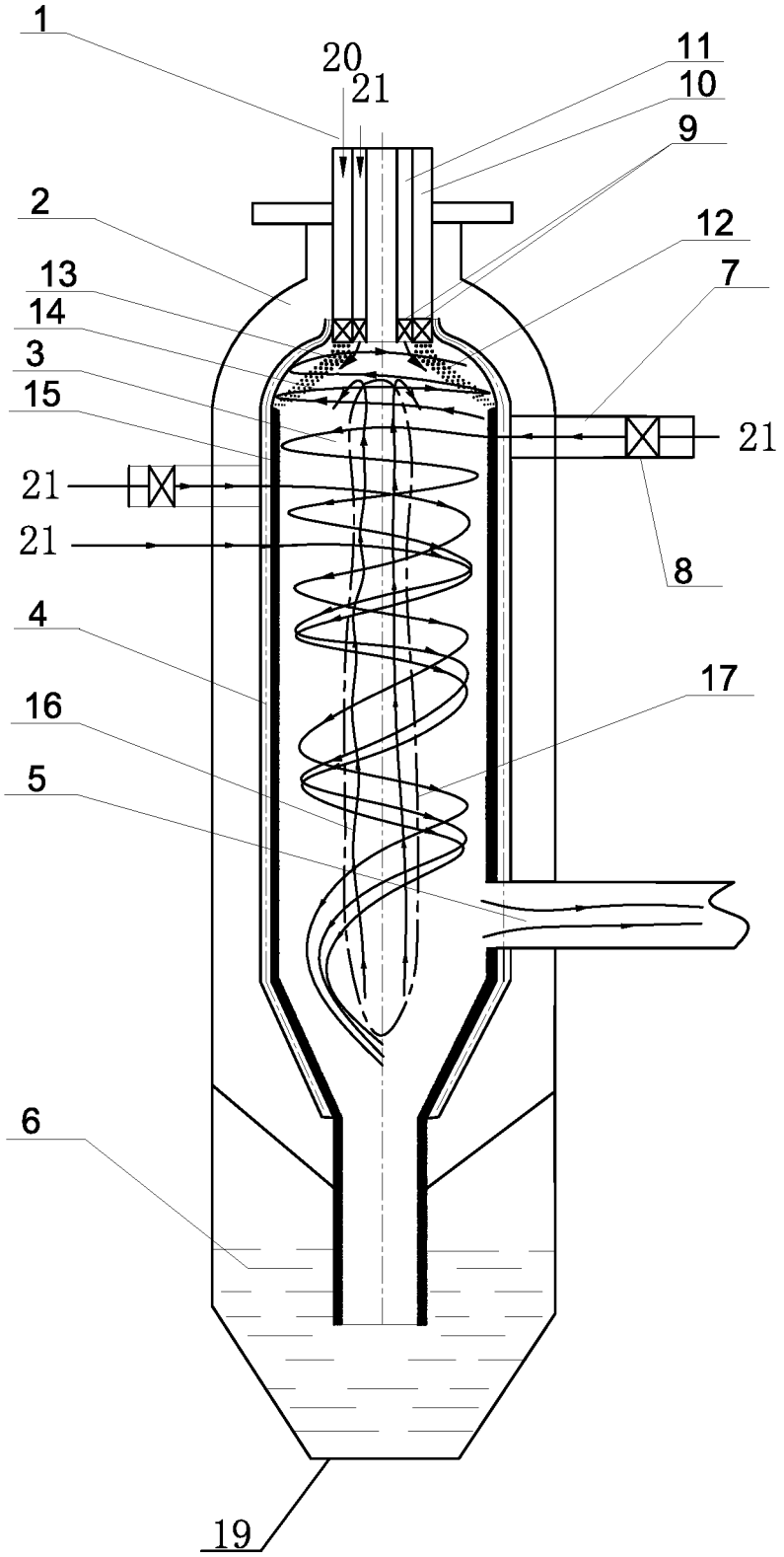
FIG. 9 is an illustration of the overall structure of the gasification furnace when the number of gasification agent injection port is 3 according to the preferred embodiment of the present invention.
Figure 10:
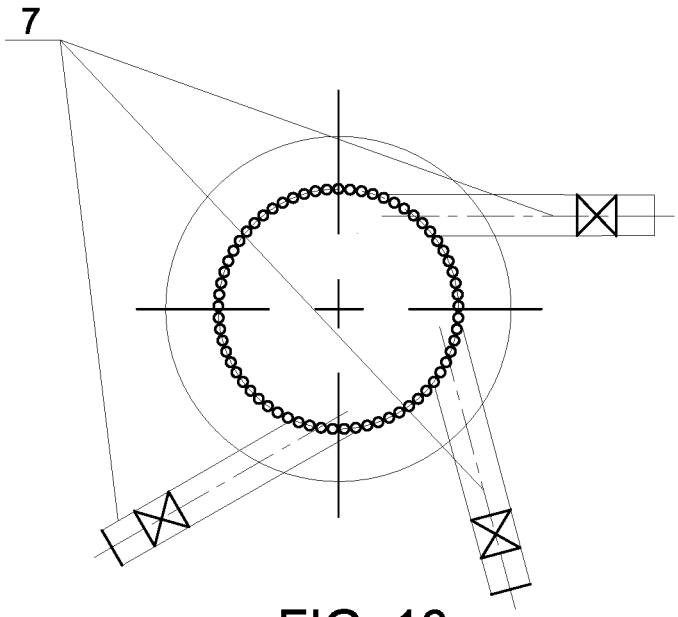
FIG. 10 is an A-A sectional view of FIG. 9 when the gasification agent injection ports are aligned in a staggered pattern.
Figure 11:
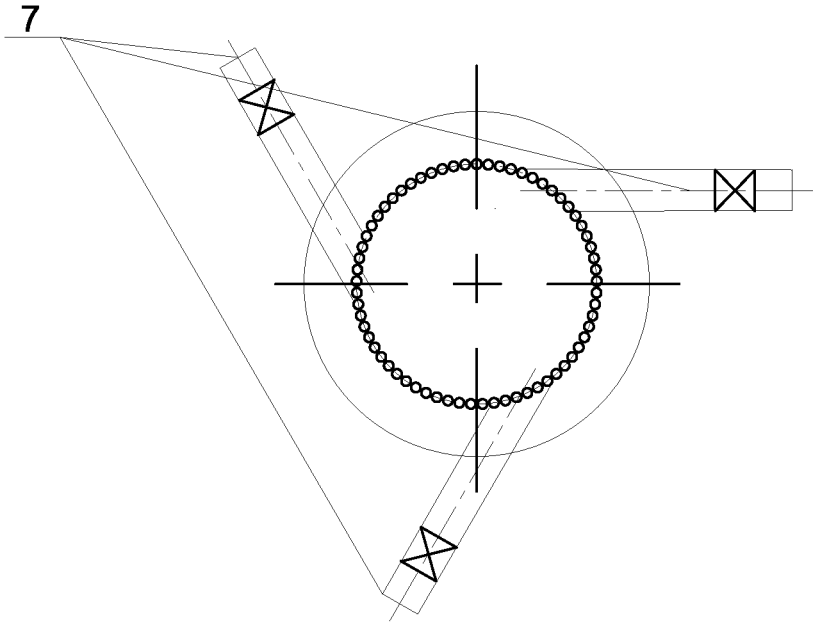
FIG. 11 is an A-A sectional view of FIG. 9 when the gasification agent injection ports are aligned uniformly.
Figure 12:
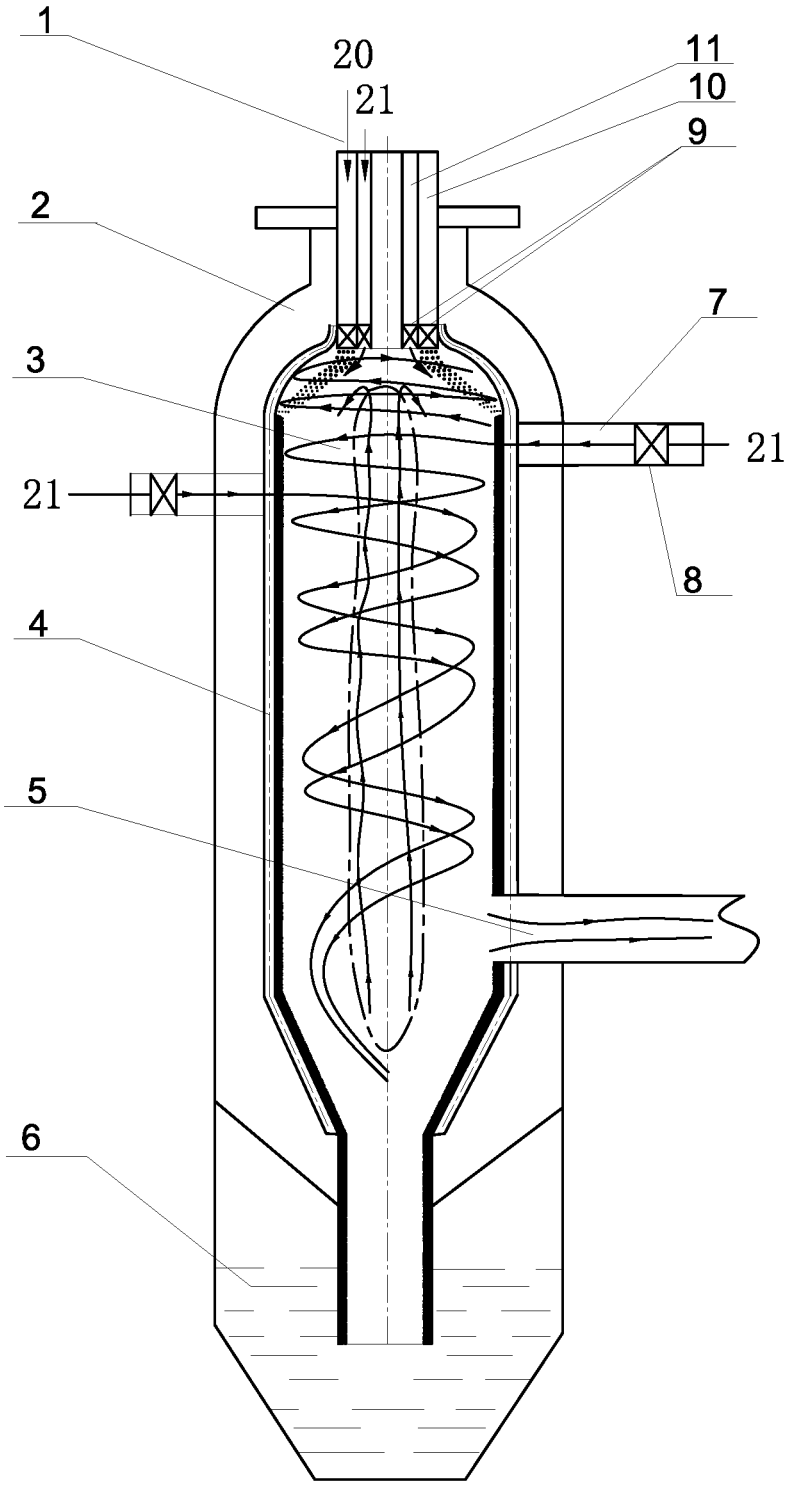
FIG. 12 is an illustration of the overall structure of the gasification furnace when the number of gasification agent injection port is 2 according to the preferred embodiment of the present invention.
Figure 13:
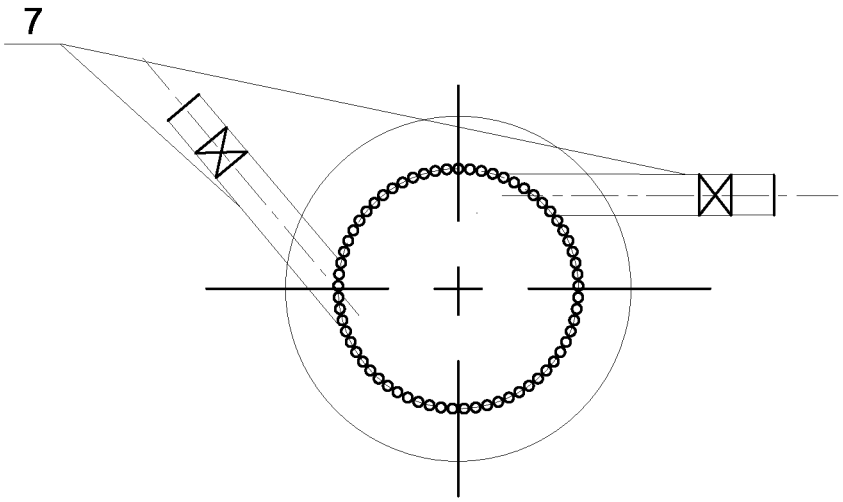
FIG. 13 is an A-A sectional view of FIG. 12 when the gasification agent injection ports are aligned in a staggered pattern.
Figure 14:
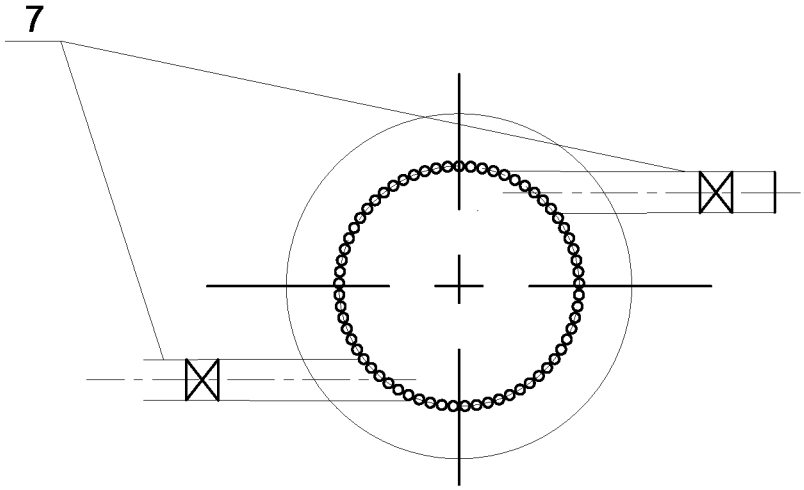
FIG. 14 is an A-A sectional view of FIG. 12 when the gasification agent injection ports are aligned uniformly.
Figure 15:
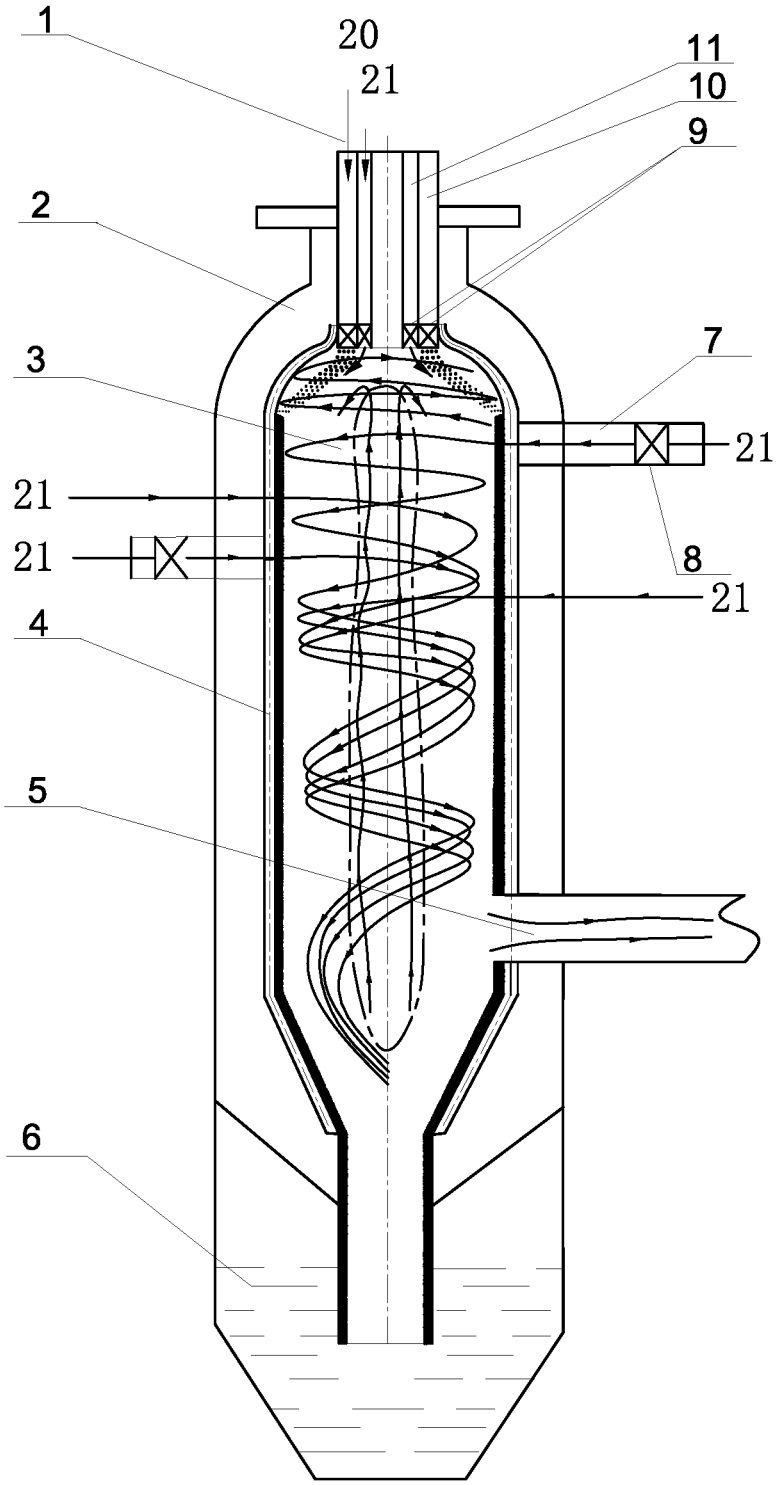
FIG. 15 is an illustration of the overall structure of the gasification furnace when the number of gasification agent injection port is 4 according to the preferred embodiment of the present invention.
Figure 16:
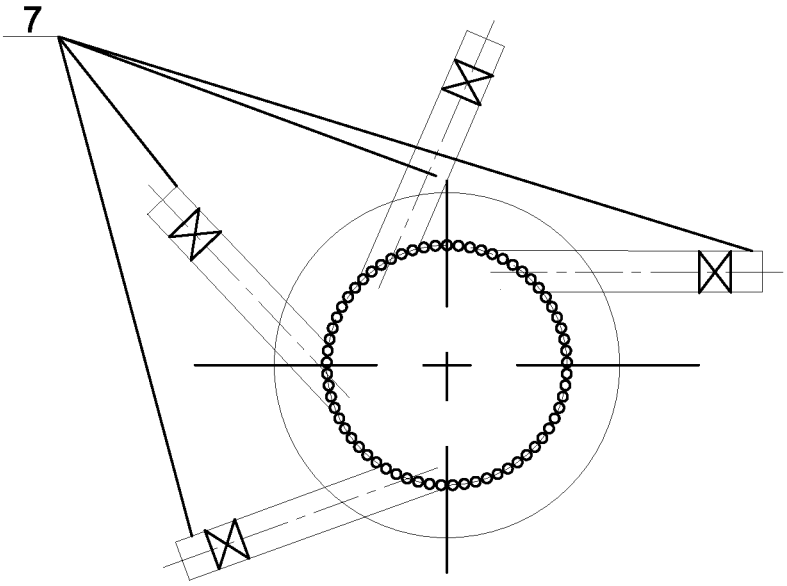
FIG. 16 is an A-A sectional view of FIG. 15 when the gasification agent injection ports are aligned in a staggered pattern.
Figure 17:
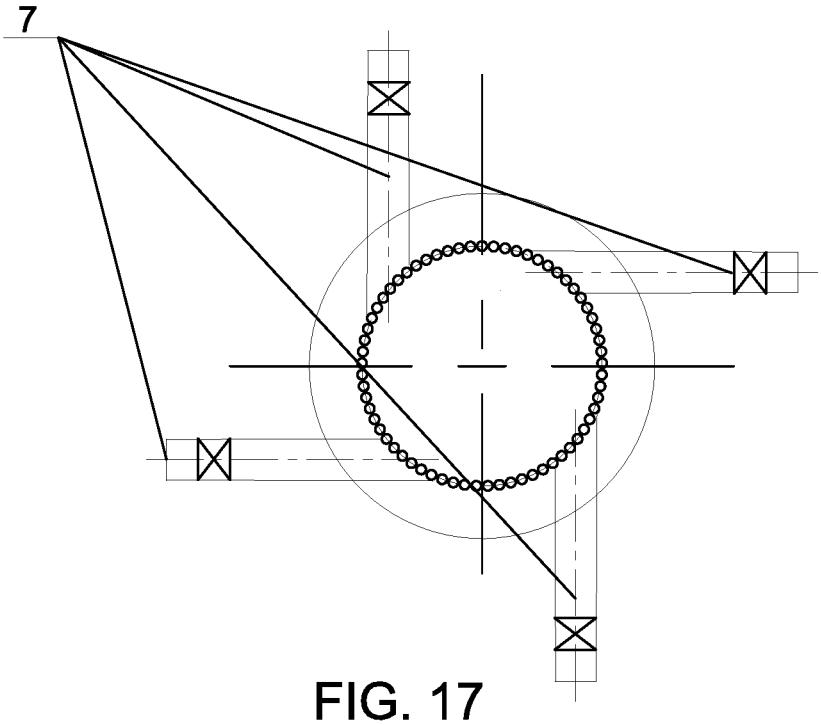
FIG. 17 is an A-A sectional view of FIG. 15 when the gasification agent injection ports are aligned uniformly.
Figure 18:
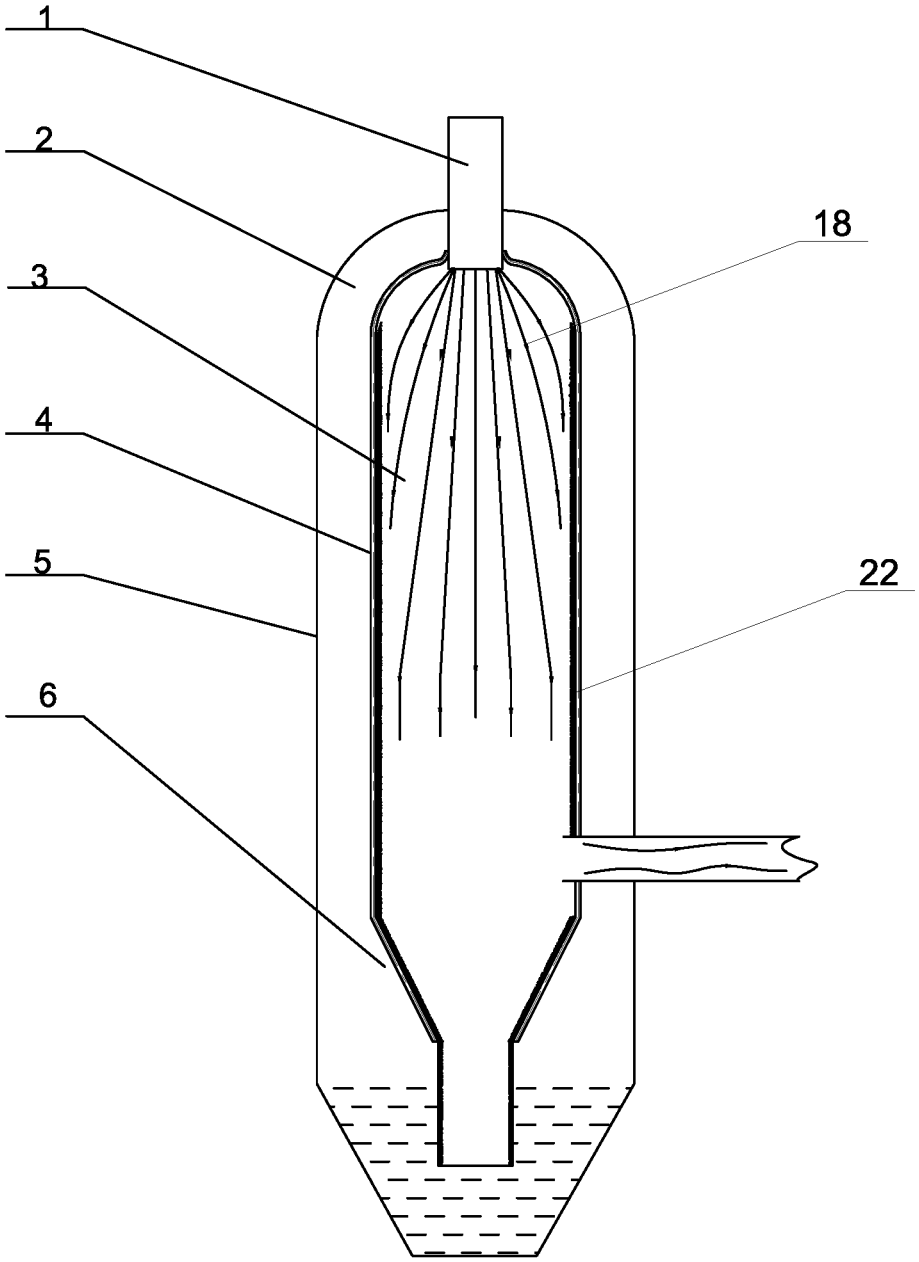
FIG. 18 illustrates the airflow trajectory of an existing furnace (the numerical reference 18 refers to gasification and pulverized coal, the numerical reference 18 refers to slag film).

This embodiment is further described in connection with FIG. 1 to FIG. 17 as follows. According to this embodiment, the furnace comprises a pulverized coal burner 1, a gasification furnace body 2, a water-cool wall 4, a syngas channel 5, the water-cool wall 4 is arranged on an inner wall of the gasification furnace body 2, the water-cool wall 4 is formed by a plurality of vertical tubes, a circular cavity, namely the gasification chamber 3, is encircled by the water-cool wall 4, the pulverized coal burner 1 is positioned on a top portion of the gasification furnace body 2 and the axis of the pulverized coal burner 1 is overlapped with the axis of the gasification chamber 3 such that a flow of the pulverized coal is evenly distributed in all direction inside the furnace; a slag pool 6 is arranged in a bottom portion of the gasification furnace body 2, the syngas channel 5 is arranged at an outer side wall in a lower portion of the gasification furnace body 2 in a manner that the syngas channel 5 and the gasification chamber 3 is channeled through, the pulverized coal gasification furnace with multi-level feeding of high speed circulating gasification agent further comprises a gasification agent injection port 7, a flow control valve 8, a swirl vane unit 9, a pulverized coal channel 10 and a gasification agent channel 11, the injection port 7 is arranged at a side wall in an upper portion of the gasification furnace body 2, the injection port 7 is inserted inside the gasification chamber 3 along a tangential direction of the gasification chamber 3 such that a very strong field of circular gas flow inside the gasification furnace is facilitated; each gasification agent injection port 7 comprises a flow control valve 8, the ring-shaped gasification agent channel 11 and the ring-shaped pulverized coal channel 10 are coaxially and radially extended from the inner side to the outer side of the pulverized coal burner 1, the pulverized coal channel 10 and the gasification agent 11 comprise a swirl vane unit 9 near the combustion side respectively.

Embodiment 2

This embodiment is described in connection with FIG. 1 to FIG. 17 as follows. According to this embodiment, the number of gasification agent injection port 7 is 1, 2, 3 or 4. Accordingly, based on the size of the gasification furnace, the adjustment of the intensity distribution for the field of circular gas flow inside the gasification furnace is facilitated. The other components and connecting relationships are the same as that of the embodiment 1.

Embodiment 3

This embodiment is described in connection with FIG. 3 to FIG. 17 as follows. According to this embodiment, the plurality of gasification agent injection ports 7 are evenly distributed and sequentially arranged from the top to the bottom along the height direction in the upper portion of the gasification furnace body 2 such that a very strong field of circular gas flow inside the gasification furnace is facilitated. The other components and connecting relationships are the same as that of the embodiment 1.

Embodiment 4

This embodiment is described in connection with FIG. 3 to FIG. 8 as follows. According to this embodiment, the center of all the gasification agent injection ports 7 are positioned on the same vertical line perpendicular to the horizontal plane. The other components and connecting relationships are the same as that of the embodiment 1.

Embodiment 5

This embodiment is described in connection with FIG. 9 to FIG. 17 as follows. According to this embodiment, the gasification agent injection ports 7 are aligned in a staggered arrangement or evenly distributed along the circumferential direction of the gasification furnace body 2. The other components and connecting relationships are the same as that of the embodiment 1.

Embodiment 6

This embodiment is described in connection with FIG. 1 to FIG. 17 as follows. According to this embodiment, the implementation method is realized by the following steps:

Step 1: setting parameters for the gasification chamber 3;

Setting the internal pressure of the gasification chamber to 0.1~4 MPa, the operating temperature to 1250~1600° C.;

Step 2: feeding pulverized coal;

Feeding the pulverized coal with a temperature of 25~100° C., carried by the nitrogen gas or carbon dioxide gas in a circulating gas flow pattern, through the pulverized coal channel 10 on the pulverized coal burner 1, to the gasification chamber 3, injecting the gasification agent, which is 10%~40% of total volume and has a temperature of 20~400° C. with a circulating gas flow pattern, through the gasification agent channel 11 on a pulverized coal burner 1 to the gasification chamber 3. The gasification agent and the pulverized coal are mixed in the top portion of the gasification furnace and flow at the same direction downwardly in a circular pattern;

Step 3: burning pulverized coal to form molten slag;

The mixture gas flow of the pulverized coal and gasification agent contact the entrained high temperature syngas in the center backflow region and are ignited by the high temperature syngas, and form a molten slag through burning in the top portion of the gasification chamber 3;

Step 4: Gasification process of molten slag inside the gasification furnace;

The remaining gasification agent, which is 60%~90% of total volume and has a temperature of 20~400° C., through the gasification agent injection port 7 on the side wall, is injected into the gasification chamber 3 at a tangential direction and at a speed of 100~200 m/s; the high speed gasification agent is flowed into the gasification chamber 3 and form a very strong circular gas flow; under the centrifugal effect, 70%-80% of the molten slag is forced to the inner wall to form a relatively thick slag layer, that the slag layer is a uniform slag layer; the circular gas flow is acting onto the slag layer on the inner wall of the gasification chamber continuously through which a very vigorous gasification reaction is occurred;

Step 5: Slag removal;

The crude coal gas produced by gasification process flows out the gasification chamber 3 through the syngas channel 5, the liquid slag produced flows to the slag pool 6 along the wall surface and is discharged from the gasification furnace through a slag outlet in the bottom portion.

Embodiment 7

This embodiment is described in connection with FIG. 1 to FIG. 17 as follows. According to this embodiment, in the step 1, the internal pressure of the gasification chamber 3 is set to 2.5 MPa, the operating temperature is set to 1500° C. The other steps are the same as the above embodiment.

Embodiment 8

This embodiment is described in connection with FIG. 1 to FIG. 17 as follows. According to this embodiment, in the step 2, the temperature of the pulverized coal is 50° C., the temperature of the gasification agent is 100° C. The other steps are the same as the above embodiment.

Embodiment 9

This embodiment is described in connection with FIG. 1 to FIG. 17 as follows. According to this embodiment, in the step 2, the temperature of the pulverized coal is 80° C., the temperature of the gasification agent is 200° C. The other steps are the same as the above embodiment.

Embodiment 10

This embodiment is described in connection with FIG. 1 to FIG. 17 as follows. According to this embodiment, in the step 4, the gasification agent is injected through the injection port 7 into the gasification chamber 3 tangentially at a multi-stage manner or at a multi-level manner along the height of the furnace. The other steps are the same as the above embodiment.

Embodiment 11

This embodiment is described in connection with FIG. 1 to FIG. 17 as follows. According to this embodiment, in the step 2, based on the total volume of gasification agent required for normal operation of the gasification furnace, 30% of the total volume is injected into the gasification chamber 3 through the gasification agent channel 11, in the step 4, the remaining 70% of the gasification agent is injected into the gasification chamber 3 tangentially at a speed of 150 m/s through the injection port 7. The other steps are the same as the above embodiment.

Embodiment 12

This embodiment is described in connection with FIG. 1 to FIG. 17 as follows. According to this embodiment, in the step 2, based on the total volume of gasification agent required for normal operation of the gasification furnace, 50% of the total volume is injected into the gasification chamber 3 through the gasification agent channel 11, in the step 4, the remaining 50% of the gasification agent is injected into the gasification chamber 3 tangentially at a speed of 160 m/s through the injection port 7. The other steps are the same as the above embodiment.

Embodiment 13

This embodiment is described in connection with FIG. 1 to FIG. 17 as follows. According to this embodiment, in the step 2, based on the total volume of gasification agent required for normal operation of the gasification furnace, 80% of the total volume is injected into the gasification chamber 3 through the gasification agent channel 11, in the step 4, the remaining 20% of the gasification agent is injected into the gasification chamber 3 tangentially at a speed of 150 m/s through the injection port 7. The other steps are the same as the above embodiment.

Embodiment 14

This embodiment is described in connection with FIG. 1 to FIG. 17 as follows. According to this embodiment, in the step 2 and the step 4, the gasification agent are both oxygen and steam, the mass ratio of steam and oxygen is 0~0.4:1. The other steps are the same as the above embodiment.

Embodiment 15

This embodiment is described in connection with FIG. 1 to FIG. 17 as follows. According to this embodiment, in the step 2, the volume of pulverized coal is 1%~25% of the total volume of the mixture gas of pulverized coal and nitrogen, or the volume of pulverized coal is 1%~25% of the total volume of the mixture gas of pulverized coal and carbon dioxide, thereby the reduction in the amount of nitrogen or carbon dioxide is facilitated and the cost of gas transmission is reduced, while the content of the effective gas (carbon monoxide and hydrogen) in the synthetic gas generated by the gasification furnace is relatively high. The other steps are the same as the above embodiment.

Working principle of the present invention:

The working principle in the gasification furnace is illustrated in FIG. 1 to FIG. 17 of the drawings. The pulverized coal carried by nitrogen or carbon dioxide is fed into the pulverized coal channel 10 of the burner 1, flows through the swirl vane unit 9 and then flows in a circulating pattern into the gasification chamber 3, forms a pulverized coal flow 12 with a circular and downward flow direction in the top portion of the gasification chamber 3. About 10%~40% of the gasification agent 21 (oxygen and steam) flows into the gasification agent channel 11 of the burner 1, through the swirl vane unit 9 to become a circulating flow into the gasification chamber 3, and generates a gasification agent flow 13 with a circular and downward flow direction in the top portion of the gasification chamber 3. The pulverized coal flow 12 and the gasification flow 13 are both flowing in the same direction and in a circulating direction, through which the two gas flow are mixed continuously. The mixture gas flow of the pulverized coal and gasification agent is then ignited after mixing with the entrained high temperature syngas in the center backflow region, then burning to form a molten slag in a top portion of the gasification chamber 3. The remaining 60%~90% gasification agent 21 is injected tangentially at high speed into the gasification chamber 3 through the gasification agent injection port 7 and is restricted by the inner wall of the gasification chamber 3, thus forming a very strong circulating flow of gasification agent. Under the effect of this strong flow of circulating gasification agent, the pulverized coal is burnt to form a molten slag, the flow of the entrained high temperature syngas and the gasification agent are flowing in a circulating and downward direction near the inner wall of the gasification chamber; under the centrifugal effect generated by the strong circulating gas flow, about 80% of the molten slag is forced onto the wall surface to form a uniform and thick layer of molten slag. The remaining 20% of molten slag, the flow of the entrained high temperature syngas and the gasification agent are mixed to flow together in a circulating and downward direction near the inner wall surface continuously. The slag layer flows downwardly and slowly along the inner wall, while the strong circulating flow of mixture gas keeps exerting force onto the slag layer on the inner wall. Through this process, strong gasification reaction occurs continuously between the gasification agent in the mixture gas flow, the slag layer on the wall surface, and the molten slag in the mixture gas flow. After the reaction, the slag layer continues to flow downwardly to the slag pool and is discharged from the slag outlet. The downward circulating mixture gas undergoes gasification reaction continuously and is converted into high temperature syngas flow when reaching to the bottom portion of the gasification furnace. Since the mixture gas flow is circulating near the inner wall of the furnace, the pressure in the center of the gasification chamber is relatively lower, the syngas in the bottom portion of the gasification chamber is then under the entrainment effect to flow upward in the center portion of the gasification chamber to form a stable high temperature center backflow region. The high temperature syngas drawn by the high temperature center backflow region flows back to the top portion of the gasification furnace and ignites the mixture gas flow of pulverized coal and gasification agent from the burner 1, which is then circulated downwardly near the inner wall again. Finally, the syngas produced flows out through the syngas channel 5.

Application of Embodiment 1

Based on a gasification furnace with a gas production capacity of 80000 $Nm^3/h$ according to the present invention, it is estimated that no burning damage will occur for 4 years and continuous running for 4 years is ensured. Compared to other technologies, the economic loss of 160 million yuan is reduced. Through verification by numerical methods: a thickness of the slag layer on the wall of the gasification furnace is 6 mm, the slag layer is even and is relatively thicker; the retention time of the pulverized coal inside the furnace is 14 s, that the retention time is relative longer; the highest temperature in the upper portion of the furnace is 1510° C., the lowest temperature in the bottom portion is 1420° C., the temperature difference along the same horizontal level inside the furnace is less than 30° C., the temperature along the height direction and the circumferential direction of the furnace are evenly distributed; the relative speed of the pulverized coal and the gasification agent at the inlet of the gasification agent is 150 m/s, the relative speed of the pulverized coal and the gasification agent at the syngas outlet is 75 m/s, the average relative speed of the pulverized coal and gasification agent is about 115 m/s, the relative speed of the pulverized coal and the gasification agent is high, the gas dispersion to the granular surface is fast and the reaction rate is high.

A chemical plant utilizes a gasification furnace with a gas production capacity of 80000 $Nm^3/h$ according to the present technology in the art, the retention time of the pulverized coal inside the furnace is about 5 s, the relative speed of the gasification agent and the molten slag is 0.1 m/s; a thickness of the slag layer on the water-cool wall surface is relatively thinner, which is about 2 mm, and the layer thickness is uneven; the temperature in the upper portion of the furnace is 1650° C., the temperature in the bottom portion is 1300° C., the temperature difference along the height direction is relatively high; some part of the inner wall surface is exposed under high temperature gas environment, the inner wall surface is easily burnt, the average number of incidence of stop running due to inner wall surface damage is one per year and the total economic loss of a one-time stop in operation is about 40 million yuan.

Preferably, the spacing along the height direction between the gasification agent injection port at the uppermost level and the gasification agent injection port at the lowermost level is 0.5D~0.7D, wherein D refers to the diameter of the circle encircled by the center of the tubes of the water-cool wall, which is uniformly disposed in the middle between the gasification injection port at the uppermost level and the lowermost level along the height direction.

What is claimed is:

1. A method of gasification utilizing a pulverized coal gasification furnace with multi-level feeding of high speed circulating gasification agent, wherein said pulverized coal gasification furnace with multi-level feeding of high speed circulating gasification agent comprises a pulverized coal burner (1), a gasification furnace body (2), a water-cool wall (4), a syngas channel (5), wherein said water-cool wall (4) is arranged on an inner wall of said gasification furnace body (2), wherein said water-cool wall (4) is formed by a plurality of vertical tubes, and a gasification chamber (3) is defined through a circulating cavity encircled by said water-cool wall (4), said pulverized coal burner (1) is positioned on a top portion of said gasification furnace body (2) and defines an axis of said pulverized coal burner (1) which is overlapped with an axis of said gasification chamber (3), wherein a slag pool (6) is arranged in a bottom portion of said gasification furnace body (2), wherein said syngas channel (5) is arranged at an outer side wall in a lower portion of said gasification furnace body (2) in a manner that said syngas channel (5) and said gasification chamber (3) is channeled through, wherein said pulverized coal gasification furnace with multi-level feeding of high speed circulating gasification agent further comprises a number of gasification agent injection ports (7), a plurality of flow control valves (8), a plurality of swirl vane units (9), a pulverized coal channel (10) and a plurality of gasification agent channels (11), wherein said injection ports (7) are arranged at a side wall in an upper portion of said gasification furnace body (2), said injection ports (7) are inserted inside said gasification chamber (3) along a tangential direction of said gasification chamber (3), each said gasification agent injection port (7) comprises one said flow control valve (8), said ring-shaped gasification agent channel (11) and said ring-shaped pulverized coal channel (10) are arranged coaxially and radially extending from said inner side to said outer side of said pulverized coal burner (1), and one said swirl vane unit (9) is provided for said pulverized coal channel (10) and said gasification agent (11) near a combustion side respectively, wherein said method comprises the steps of:

Step 1: setting parameters for said gasification chamber 3;

Setting an internal pressure of said gasification chamber to 0.1~4 MPa, an operating temperature to 1250~1600° C.;

Step 2: feeding said pulverized coal;

feeding said pulverized coal with a temperature of 25~100° C., carried by nitrogen gas or carbon dioxide gas in a circulating airflow pattern through said pulverized coal channel (10) on said pulverized coal burner (1) to said gasification chamber (3); injecting said gasification agent, which is 10%~40% of a total volume and has a temperature of 20~400° C. with a circulating airflow pattern, through said gasification agent channel (11) on said pulverized coal burner (1) to said gasification chamber (3), wherein said gasification agent and said pulverized coal are mixed in said top portion of said gasification furnace and flow at the same direction downwardly in a circular pattern;

Step 3: burning said pulverized coal to form molten slag;

a mixture gas flow of said pulverized coal and said gasification agent contacts an entrained high temperature syngas in a center backflow region and is ignited by said high temperature syngas to form molten slag through burning in said top portion of said gasification chamber (3);

Step 4: Gasification process of said molten slag inside said gasification furnace;

injecting a remaining portion of gasification agent, which is 60%~90% of the total volume and has a temperature of 20~400° C. through said gasification agent injection ports (7) on said side wall into said gasification chamber (3) at a tangential direction and at a speed of 100~200 m/s, wherein said gasification agent at high speed forms a very strong circular airflow after flowing into said gasification chamber (3), then under a centrifugal effect, 70%-80% of said molten slag is forced to said inner wall to form a slag layer, that said slag layer is a uniform slag layer, and said circular airflow is acting onto said slag layer on said inner wall of said gasification chamber continuously through which a very vigorous gasification reaction is occurred;

Step 5: removing slag;

a crude coal syngas produced by said gasification process flows out said gasification chamber (3) through said syngas channel (5), a liquid slag being produced flows to said slag pool (6) along said wall surface and is discharged from said gasification furnace through a slag outlet in said bottom portion.

2. The method of gasification according to claim 1 in which the strong airflow of said gasification agent is injected from said top portion and said furnace body for pulverized coal gasification process, characterized in that, in said step 4, said gasification agent is injected through said injection port (7) into said gasification chamber (3) on said side wall at a tangential direction in a multi-stage manner or at a multi-level manner along said height direction of said gasification chamber (3).

3. A method of gasification utilizing the pulverized coal gasification furnace with multi-level feeding of high speed circulating gasification agent according to 1, characterized in that, wherein said number of gasification agent injection port (7) is 2, 3 or 4.

4. The method of gasification according to claim 3 in which the strong airflow of said gasification agent is injected from said top portion and said furnace body for pulverized coal gasification process, characterized in that, in said step 4, said gasification agent is injected through said injection port (7) into said gasification chamber (3) on said side wall at a tangential direction in a multi-stage manner or at a multi-level manner along said height direction of said gasification chamber (3).

5. The method of gasification utilizing the pulverized coal gasification furnace with multi-level feeding of high speed circulating gasification agent according to claim 1, characterized in that, wherein said gasification agent injection ports (7) are evenly distributed and sequentially arranged from said top to said bottom along a height direction in said upper portion of said gasification furnace body (2).

6. The method of gasification according to claim 5 in which the strong airflow of said gasification agent is injected from said top portion and said furnace body for pulverized coal gasification process, characterized in that, in said step 4, said gasification agent is injected through said injection port (7) into said gasification chamber (3) on said side wall at a tangential direction in a multi-stage manner or at a multi-level manner along said height direction of said gasification chamber (3).

7. The method of gasification utilizing the pulverized coal gasification furnace with multi-level feeding of high speed circulating gasification agent according to claim 5, wherein a center of all said gasification agent injection ports (7) are positioned on the same vertical line perpendicular to a horizontal plane.

8. The method of gasification utilizing the pulverized coal gasification furnace with multi-level feeding of high speed circulating gasification agent according to claim 5, wherein said gasification agent injection ports (7) are aligned in a staggered arrangement or evenly distributed along said circumferential direction of said gasification furnace body (2).

9. The method of gasification according to claim 8 in which the strong airflow of said gasification agent is injected from said top portion and said furnace body for pulverized coal gasification process, characterized in that, in said step 4, said gasification agent is injected through said injection port (7) into said gasification chamber (3) on said side wall at a tangential direction in a multi-stage manner or at a multi-level manner along said height direction of said gasification chamber (3).

10. The method of gasification utilizing the pulverized coal gasification furnace with multi-level feeding of high speed circulating gasification agent according to claim 3, wherein said gasification agent injection ports (7) are evenly distributed and sequentially arranged from said top to said bottom along a height direction in said upper portion of said gasification furnace body (2).

11. A method of gasification utilizing the pulverized coal gasification furnace with multi-level feeding of high speed circulating gasification agent according to claim 10, wherein a center of all said gasification agent injection ports (7) are positioned on the same vertical line perpendicular to a horizontal plane.

12. The method of gasification utilizing the pulverized coal gasification furnace with multi-level feeding of high speed circulating gasification agent according to claim 10, wherein said gasification agent injection ports (7) are aligned in a staggered arrangement or evenly distributed along said circumferential direction of said gasification furnace body (2).

13. A method of gasification utilizing the pulverized coal gasification furnace with multi-level feeding of high speed circulating gasification agent, wherein said pulverized coal gasification furnace with multi-level feeding of high speed circulating gasification agent comprises a pulverized coal burner (1), a gasification furnace body (2), a water-cool wall (4), a syngas channel (5), wherein said water-cool wall (4) is arranged on an inner wall of said gasification furnace body (2), wherein said water-cool wall (4) is formed by a plurality of vertical tubes, and a gasification chamber (3) is defined through a circulating cavity encircled by said water-cool wall (4), said pulverized coal burner (1) is positioned on a top portion of said gasification furnace body (2) and defines an axis of said pulverized coal burner (1) which is overlapped with an axis of said gasification chamber (3), wherein a slag pool (6) is arranged in a bottom portion of said gasification furnace body (2), wherein said syngas channel (5) is arranged at an outer side wall in a lower portion of said gasification furnace body (2) in a manner that said syngas channel (5) and said gasification chamber (3) is channeled through, wherein said pulverized coal gasification furnace with multi-level feeding of high speed circulating gasification agent further comprises one gasification agent injection port (7), a plurality of flow control valves (8), a plurality of swirl vane units (9), a pulverized coal channel (10) and a plurality of gasification agent channels (11), wherein said injection port (7) are arranged at a side wall in an upper portion of said gasification furnace body (2), said injection port (7) are inserted inside said gasification chamber (3) along a tangential direction of said gasification chamber (3), said gasification agent injection port (7) comprises one said flow control valve (8), said ring-shaped gasification agent channel (11) and said ring-shaped pulverized coal channel (10) are arranged coaxially and radially extending from said inner side to said outer side of said pulverized coal burner (1), and one said swirl vane unit (9) is provided for said pulverized coal channel (10) and said gasification agent (11) near a combustion side respectively, wherein said method comprises the steps of:

Step 1: setting parameters for said gasification chamber 3;

setting an internal pressure of said gasification chamber to 0.1~4 MPa, an operating temperature to 1250~1600° C.;

Step 2: feeding said pulverized coal;

feeding said pulverized coal with a temperature of 25~100° C., carried by nitrogen gas or carbon dioxide gas in a circulating airflow pattern through said pulverized coal channel (10) on said pulverized coal burner (1) to said gasification chamber (3); injecting said gasification agent, which is 10%~40% of a total volume and has a temperature of 20~400° C. with a circulating airflow pattern, through said gasification agent channel (11) on said pulverized coal burner (1) to said gasification chamber (3), wherein said gasification agent and said pulverized coal are mixed in said top portion of said gasification furnace and flow at the same direction downwardly in a circular pattern;

Step 3: burning said pulverized coal to form molten slag;

a mixture gas flow of said pulverized coal and said gasification agent contacts an entrained high temperature syngas in a center backflow region and is ignited by said high temperature syngas to form molten slag through burning in said top portion of said gasification chamber (3);

Step 4: Gasification process of said molten slag inside said gasification furnace;

injecting a remaining portion of gasification agent, which is 60%~90% of the total volume and has a temperature of 20~400° C. through said gasification agent injection port (7) on said side wall into said gasification chamber (3) at a tangential direction and at a speed of 100~200 m/s, wherein said gasification agent at high speed forms a very strong circular airflow after flowing into said gasification chamber (3), then under a centrifugal effect, 70%-80% of said molten slag is forced to said inner wall to form a slag layer, that said slag layer is a uniform slag layer, and said circular airflow is acting onto said slag layer on said inner wall of said gasification chamber continuously through which a very vigorous gasification reaction is occurred;

Step 5: removing slag;

a crude coal syngas produced by said gasification process flows out said gasification chamber (3) through said syngas channel (5), a liquid slag being produced flows to said slag pool (6) along said wall surface and is discharged from said gasification furnace through a slag outlet in said bottom portion.

14. The method of gasification according to claim 13 in which the strong airflow of said gasification agent is injected from said top portion and said furnace body for pulverized coal gasification process, characterized in that, in said step 4, said gasification agent is injected through said injection port (7) into said gasification chamber (3) on said side wall at a tangential direction in a multi-stage manner or at a multi-level manner along said height direction of said gasification chamber (3).

* * * * *